United States Patent [19]

La Croix

[11] Patent Number: 5,025,240

[45] Date of Patent: Jun. 18, 1991

[54] METHOD AND APPARATUS FOR FORMING MAGNETIZED ZONES ON A MAGNETIZABLE BODY

[75] Inventor: Mark E. La Croix, New Hartford, Conn.

[73] Assignee: The Torrington Company, Torrington, Conn.

[21] Appl. No.: 400,635

[22] Filed: Aug. 30, 1989

[51] Int. Cl.[5] ..... H01F 13/00

[52] U.S. Cl. ..... 335/284; 361/146

[58] Field of Search ..... 335/284, 302, 306; 361/143, 146

[56] References Cited

U.S. PATENT DOCUMENTS 3,409,853 11/1968 Guerth ..... 335/284
4,043,297 8/1977 Hartmann et al. ..... 335/284 X
4,614,929 9/1986 Tsukuda et al. ..... 335/284
4,737,753 4/1988 Oudet ..... 335/284

*Primary Examiner*—George Harris
*Attorney, Agent, or Firm*—Frank S. Troidl; Michael H. Minns

[57] ABSTRACT

The apparatus is used to make a magnet with a plurality of magnetic pole pairs. One or more pole pairs is formed by the apparatus as an initial step. Thereafter, additional pole pairs are formed by moving the apparatus with respect to the body to be magnetized or moving the body to be magnetized with respect to the apparatus. The apparatus is constructed so that previously magnetized portions of the magnetizable body are not demagnetized or significantly altered by the magnetization of adjacent parts of the magnetizable body.

10 Claims, 2 Drawing Sheets

FIG. 4
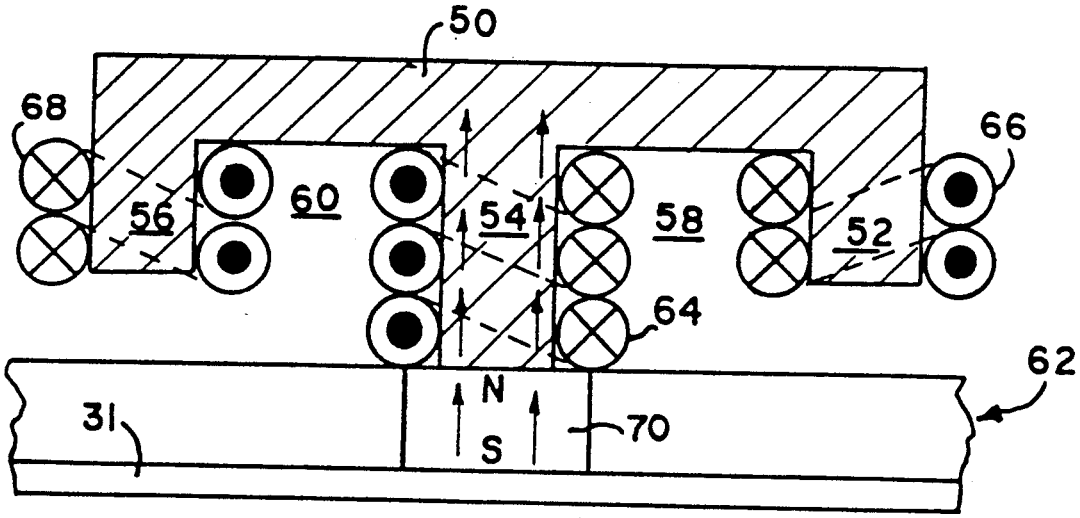
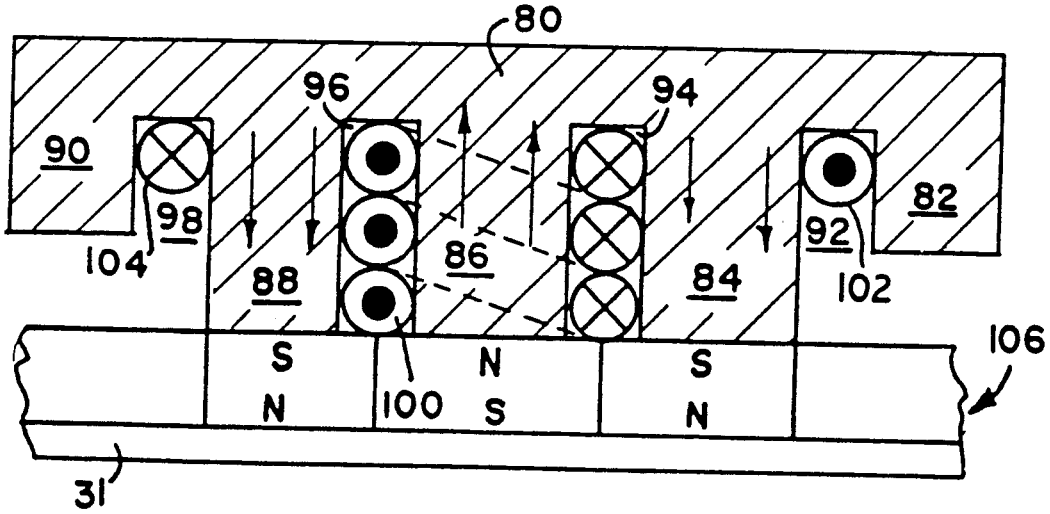
FIG. 5
FIG. 6
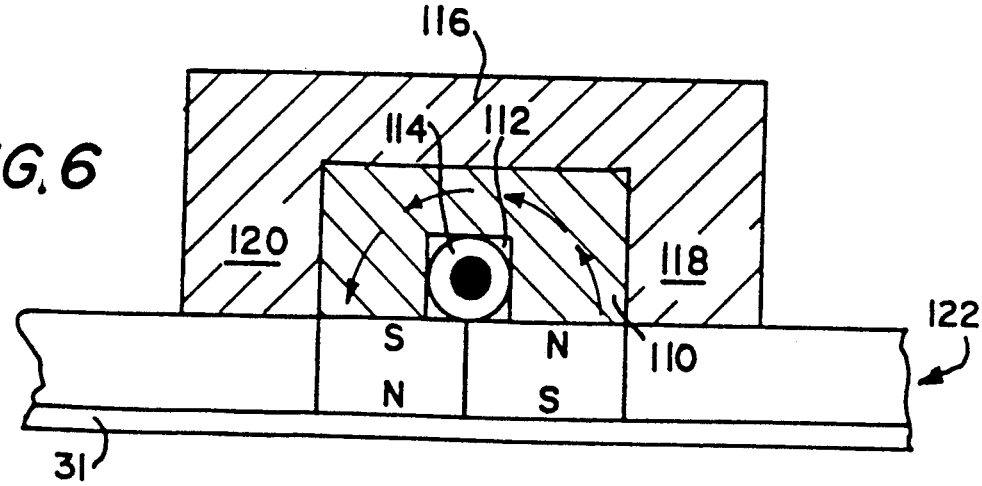

METHOD AND APPARATUS FOR FORMING MAGNETIZED ZONES ON A MAGNETIZABLE BODY

This invention relates to the making of magnets. More particularly, this invention is a new apparatus and method for forming a number of magnetic poles on a magnetizable body by a series of steps when it is difficult, inconvenient, or impossible to magnetize the entire magnetizable body by a single step.

A conventional way of making magnets, such as annular magnets with a plurality of pole pairs around its circumference is to use a single fixture which magnetizes the annular magnetizable member to form all of the pole pairs simultaneously. Examples of devices and methods for making magnets by forming all the pole pairs in one step are shown in U.S. Pat. No. 4,614,929 dated Sept. 30, 1986 in the name of Tsukada et al and entitled "Method for Manufacture of Magnet" and U.S. Pat. No. 4,737,753 dated Apr. 12, 1988 in the name of Claude Oudet and entitled "Multipoler Magnetization Device".

Often, however, because of obstructions adjacent a portion of the circumference of an annular or flat magnetizable member to be magnetized or other space limitations, it is impossible or difficult to fit a single device in the available space to make the magnet in one step. My new method and apparatus for magnetizing a magnetizable member may be used in applications where there are space limitations and a one step magnetizing apparatus cannot be used.

With my new method of making a magnet, consecutive steps form a series of magnetized zones on a magnetizable body. This is done by using the new apparatus to form at least one pole pair, then either moving the apparatus or the magnetizable body a small distance and then magnetizing the magnetizable member in the next step in order to form the next magnetic pole pair. However, certain difficulties must be overcome when utilizing this method when compared to the one step method of magnetizing a magnetizable body such as shown in the U.S. Pat. No. 4,614,929 and 4,737,753. For example, the apparatus must be constructed so that the extent of each pole pair is carefully controlled to be a predetermined zone. Also, the apparatus must be constructed so that after the first one or more pole pairs are formed, the application of any subsequent magnetization does not erase or significantly modify any already magnetized pole pairs. It is usually necessary that the magnetization along the entire length of a flat body or the entire circumference of an annular body for example be equi-distant pole pairs of flux levels of approximately equal magnitude.

Briefly described, my invention comprises a magnetizing conductor. An electric current pulse source feeds an electric current pulse through the magnetizing conductor to create a magnetic field. At least one magnetic field dampening means is provided. The dampening means is positioned so that the magnetic field created by the pulse fed through the magnetizing conductor is dampened adjacent the magnetic field dampening means. Thus, an electric current pulse fed through the magnetizing conductor creates a magnetic field which penetrates that portion of the magnetizable body adjacent the magnetizing conductor to create desired magnetized pole pair zones with substantially no penetration of that portion of the magnetizable body adjacent the dampening means.

Briefly described my new method of forming a magnet comprises the steps of first forming at least one pole pair on the magnetizable body which has a predetermined zone. Thereafter, in consecutive steps forming additional magnetic pole pairs on the magnetizable member until the entire magnetizable member has been magnetized with the desired number of pole pairs. All the subsequent pole pairs are made without significantly disturbing the magnetization of any previously formed pole pairs so that the zone of each pole pair is carefully controlled and the resulting magnet has pole pairs of flux levels of approximately equal magnitude.

The invention as well as its many advantages will be further understood by reference to the following detailed description and drawings in which:

FIG. 4 is a sectional view of the essential parts of a second embodiment of the invention;

FIG. 5 is a sectional view of the essential parts of a third embodiment of the invention; and FIG. 6 is a sectional view of the essential parts of a fourth embodiment of the invention.

In the various figures, like parts are referred to by like numbers.

Figure 1:
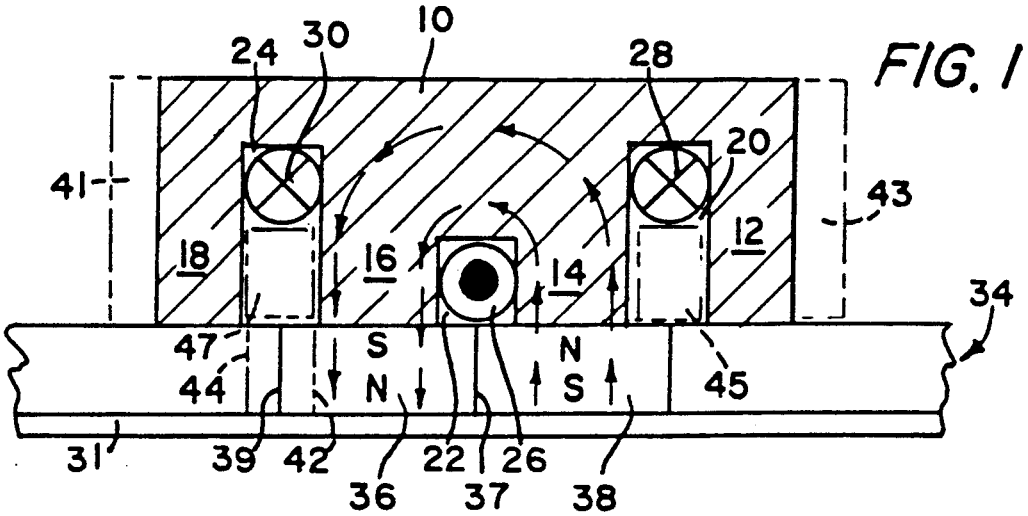
FIG. 1 ,is a cross-sectional view illustrating the essential parts of one embodiment of my new apparatus and illustrating the first step in magnetizing a magnetizable body.
Figure 2:
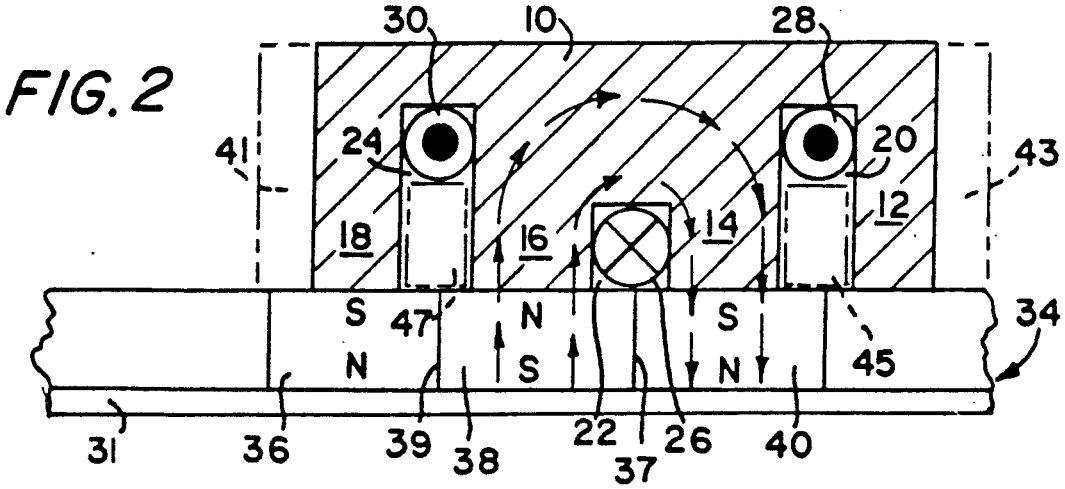
FIG. 2 is a view similar to FIG. 1 illustrating the preferred next step in magnetizing the magnetizable body.

Referring to the drawings and more particularly to FIG. 1 and FIG. 2, my new apparatus for forming a series of magnetized zones on a magnetizable body comprises a support member 10. The support member has a plurality of horizontally separated vertically extending projections 12, 14, 16, and 18 defining a plurality of horizontally separated slots 20, 22, and 24.

A magnetizing conductor 26 is lodged in the slot 22. Secondary electrical conductors 28 and 30 are lodged within slots 20 and 24, respectively. The secondary electrical conductors 28 and 30 are horizontally and vertically equally spaced from the magnetizing conductor 26. They are horizontally equally spaced in opposite directions from the magnetizing conductor and vertically equally spaced in the same direction from the magnetizing conductor.

Figure 3:
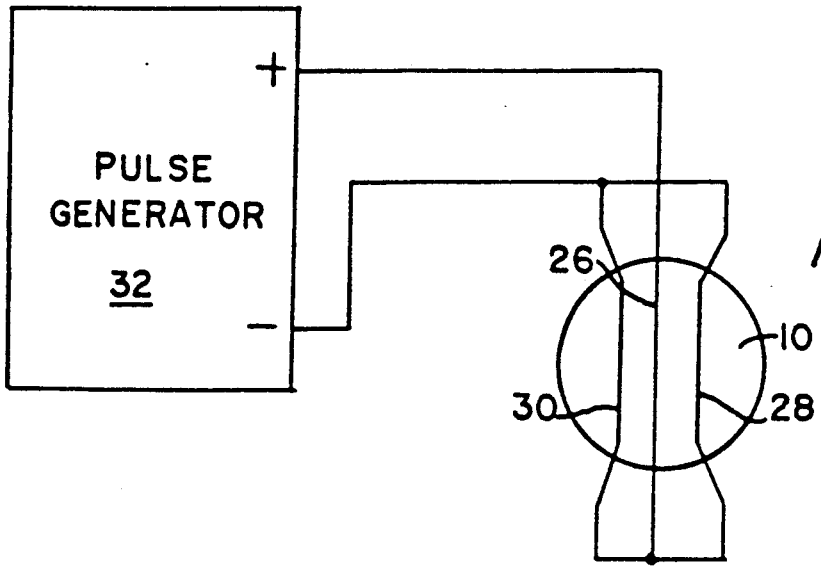
FIG. 3 is an electrical circuit diagram illustrating the source of current pulses and the relative positions of the electrical conducting members of the invention.

Referring to FIG. 3, a pulse generator 32 is used to feed electric current pulses through the magnetizing conductor 26 and the parallel arrangement of the secondary electrical conductors 28 and 30. The amperage of the current flowing through magnetizing conductor 26 is twice the amperage of the current flowing through each of the secondary electrical conductors 28 and 30.

In operation, the magnetizable body 34 may be any shape including a flat thin shape or an annular shape. If it is annular, projections 12, 14, 16, and 18 will have curved surfaces, as necessary, to conform to the curvature of the body 34. The support member 10 is placed against the member 34 to be magnetized. The pulse generator is then turned on to energize the magnetizing conductor 26 and the secondary electrical conductors 28 and 30. As shown in FIG. 1, the electric current flows through the magnetizing conductor 26 outwardly from the surface of the paper (indicated by the circle dot mark) and the electric current flows inwardly through conductors 28 and 30 into the paper (indicated by the circled cross). An S-pole forms on the upper portion of zone 36 of the body 34. An N-pole forms on the lower portion of zone 36. Also, an N-pole forms on the upper portion of zone 38 of body 34. An S-pole forms on the lower portion of zone 38. The magnetic flux and the direction of the magnetic flux may be represented by the arrows shown in FIG. 1. Notice that the arrows flow in a counter-clockwise direction.

As used herein, a "pole pair" means an N-pole and an S-pole which are shown as vertically spaced in FIG. 1 and in the remaining Figures. Thus, one pole pair has been formed in zone 36; a second pole pair has been formed in zone 38.

The magnetizable member 34 may consist of Barium Ferrite, Strontium Ferrite, or rare earth materials such as Neodymium Iron Boron, or Samarium Cobalt, and is preferably anisotropic.

A steel backing 31 tends to straighten the flux path so that the flux path through the magnetizable member 34 is vertical.

After the pole pairs have been formed at zones 36 and 38 of body 34, either the body 34 or the support member 10 is moved to the position shown in FIG. 2. An electric current pulse is then fed from the pulse generator 32 in the reverse direction from the current flow shown in FIG. 1. That is, the current flows through magnetizing conductor 26 into the paper and through secondary electrical conductors 28 and 30 out of the paper. An S-pole is formed in the upper part of zone 40 of the body 34; an N-pole is formed in the lower part of zone 40. The flux pattern may be represented by the arrows which in FIG. 2 flow clockwise around the magnetizing conductor 26. The remaining part of the body 34 is magnetized by sequentially moving either the support body 10 or the body 34 the proper distance and alternately reversing the current flow through the magnetizing conductor 26 and the secondary electrical conductors 28 and 30 until the entire part 34 is magnetized with the plurality of pairs of magnetic poles.

Important parts of the support 10 are the projection 18, the adjacent slot 24, and the conductor 30 lodged in slot 24 and also the projection 12, the adjacent slot 20 and the conductor 28 lodged in the slot 20. These each form magnetic field dampening means. They are spaced a predetermined distance from the magnetizing conductor 26 and positioned so that the magnetic field created by the pulse and fed through the magnetizing conductor 26 is dampened by the magnetic field dampening means whereby the electric current pulse fed through the magnetizing conductor 26 creates a magnetic field which penetrates only the zones 38 and 40 (see FIG. 2) of the magnetizable body with substantially no penetration of the portions of the body 34 adjacent to the dampening means.

With the flow of current as shown in FIG. 1, the magnetic flux would tend to go about the electrical conductors 28 and 30 in the clockwise direction. Thus, the flow of flux caused by the current through conductors 28 and 30 would stop or dampen any counter-clockwise flow of flux through the projections 12 and 18 and slots 20 and 24 of the body 10. With the flow of current as shown in FIG. 2, the magnetic flux would tend to go about the electrical conductors 28 and 30 in the counter-clockwise direction. Thus, the flow of flux caused by the current through conductors 28 and 30 would stop or dampen any clock-wise flow of flux through the projections 12 and 18 and slots 20 and 24. If the magnetic field dampening means were not included in the apparatus, when the support body 10 is moved from the position shown in FIG. 1 to the position shown in FIG. 2, the clockwise magnetic flux would flow through the zone 36 of the body 34 and erase or substantially lessen the magnetic flux already formed in zone 36. Also, in actual practice, the entire area of zone 38 of magnetizable body 34 is not magnetically saturated. That is, that part of zone 38 closest to magnetizing conductor 26 is saturated but the amplitudes of the magnetic flux taper off to below magnetic saturation with increased distance of portions of zone 38 from magnetizing conductor 26. However, as seen by looking at FIG. 2, that portion of zone 38 which was not saturated during the step shown in FIG. 1 can be saturated by the step shown in FIG. 2.

The borders of zones 36 and 38 are clearly defined by the location of magnetizing conductor 26 at each magnetizing step. The solid vertical line 37 indicates the clearly defined border during the magnetizing of zones 36 and 38 shown in FIG. 1. Solid vertical line 39 indicates the clearly defined border of zone 36 formed in a previous magnetizing step by locating magnetizing conductor 26 above vertical line 39. The zones may be varied by properly positioning the magnetizing conductor 26 on magnetizable body 34. For example, zone 36 could have been decreased, or increased, by positioning magnetizing conductor 26 above broken line 42, or above broken line 44, respectively, in the step preceding the step shown in FIG. 1.

If desired, magnetic field insulators used with changing magnetic fields such as 41 and 43, shown in broken lines may be located next to projections 18 and 12, respectively. Also, magnetic field insulators 45 and 47, shown in broken lines may be lodged in slots 20 and 24, respectively. The insulators are a material with high conductivity such as Aluminum, Copper, or Silver.

In the embodiment of FIG. 4, the support member 50 is provided with a plurality of vertically extending projections 52, 54, and 56 defining the slots 58 and 60.

The magnetizing conductor is a coil 64 which is wrapped around the projection 54. The secondary electrical conductors are coils 66 and 68 which are wrapped around projections 52 and 56, respectively. In the operation of the embodiment of FIG. 4, when currents are flowed through the magnetizing coil 64 and secondary electrical conducting coils 66 and 68 in the manner shown in FIG. 4, a pole pair is formed in zone 70 of the magnetizable body 62 as shown.

The support body 50 is then moved along the magnetizable body 62 or the magnetizable body 62 moved relative to the support body 50 to the next zone to be magnetized. The current through the magnetizing coil 64 and the current through the secondary electrical conducting coils 66 and 68 are reversed to form a pole pair in the opposite direction from the pole pair zone 70. In the embodiment of FIG. 4, the magnetic field dampening means includes the secondary electrical conducting coil 66 wrapped around projection 52 and the secondary electrical conducting coil 68 wrapped around projection 56. These coils are spaced from the magnetizing coil 64 a predetermined distance and are constructed so that the magnetic field created by the pulses fed through the magnetizing conductor is dampened by the magnetic field dampening means. Therefore, an electric current pulse fed through the magnetizing conductor 64 creates a magnetic field which penetrates zone 70 of the magnetizable body 62 with substantially no penetration of the portions of the magnetizable body adjacent the dampening means. Instead of three separate wires, coils 64, 66, and 68 could be part of one wire.

In the embodiment of FIG. 5, the support member 80 has a plurality of projections 82, 84, 86, 88, and 90 defining a plurality of separated slots 92, 94, 96, and 98. The lowermost extremities of projections 82 and 90 are spaced a predetermined distance from the magnetizable body 106. The magnetizing conductor 100 is wrapped around the projection 86. Secondary electrical conductors 102 and 104 are lodged in the slots 92 and 98, respectively. When the current flow through the magnetizing coil and the secondary electrical conducting coils are as shown in FIG. 5, the three pole pair zones shown are formed. The support body 80 or the magnetizable body 106 is then moved to the next location, the current through the coils are reversed and new pole pairs formed on the body 106.

The secondary electrical conductors 102 and 104 lodged in slots 92 and 98, respectively, provide the dampening of any magnetic field which otherwise would exist in the projections 82 and 90 thereby preventing any magnetizing of any portions of the body 106 adjacent the portions which are to be magnetized, and prevents the erasing or alteration of any pole pairs previously formed on the body 106, and magnetically saturates zones which have not been fully saturated. Instead of three separate wires, conductors 100, 102 and 104 could be part of a single wire.

This apparatus for forming a series of magnetized zones on a magnetizable body may also use a high conductivity material. Such an arrangement is shown in FIG. 6. The support member 110 is provided with a horizontally centralized slot 112 in which the magnetizing conductor 114 is lodged. In this embodiment, instead of secondary electrical conductors, a changing magnetic field insulator 116 is provided as a magnetic insulator. The magnetic insulator 116 is provided with horizontally separated projections 118 and 120. These projections are spaced a predetermined distance from the magnetizing conductor 114. Both projections contact the magnetizable body 122. The high conductivity material used as the changing magnetic field insulator 116 may, for example, be made of Aluminum or Copper. In operation, when the current is flowed through the magnetizing coil 114 in the direction shown in FIG. 6, the two pole pair zones shown are created. Thereafter, either the magnetizable body 122 or the support member 110 with its magnetic field insulator 116 is moved to the next location, the magnetizing current through the magnetizing coil 114 is reversed to form the next pole pair.

The magnetic fields created by the flow of current through the magnetizing coil 114 are reflected by the magnetic field insulator 116. Since the magnetic field insulator 116 includes the projections 118 and 120, the projections serve to dampen any magnetic field which might tend to penetrate the magnetizable member 122 adjacent the pole pair zones formed.

I claim:

1. Apparatus for forming a series of magnetized zones on a magnetizable body comprising: a magnetizing conductor; an electric current pulse source for feeding electric current pulses through said magnetizing conductor to create a magnetic field; and at least one magnetic field dampening means having means spaced a predetermined distance from the magnetizing conductor and positioned so that the magnetic field created by the pulses fed through the magnetizing conductor is dampened adjacent said magnetic field dampening means whereby an electric current pulse fed through the magnetizing conductor creates a magnetic field which will penetrate that portion of the magnetizable body adjacent the magnetizing conductor with substantially no penetration of that portion of the magnetizable body adjacent the dampening means.

2. Apparatus for forming a series of magnetized zones on a magnetizable body comprising: a support member; a magnetizing conductor mounted on the support member; an electric current pulse source for feeding electric current pulses through said magnetizing conductor to create a magnetic field; and at least one magnetic field dampening means having means spaced a predetermined distance from the magnetizing conductor and positioned so that the magnetic field created by the pulses fed through the magnetizing conductor is dampened adjacent said magnetic field dampening means whereby an electric current pulse fed through the magnetizing conductor creates a magnetic field which will penetrate that portion of the magnetizable body adjacent the magnetizing conductor with substantially no penetration of that portion of the magnetizable body adjacent the dampening means.

3. Apparatus in accordance with claim 2 wherein there are two magnetic field dampening means, each one being an electrical conductor, equally spaced in opposite directions from the magnetizing conductor.

4. Apparatus in accordance with claim 2 wherein the magnetic field dampening means comprises: a changing magnetic field insulator having two horizontally separated projections, each one being equally spaced in opposite directions from the magnetizing conductor.

5. Apparatus in accordance with claim 3 wherein each secondary electrical conductor is horizontally and vertically equally spaced from the magnetizing conductor.

6. Apparatus in accordance with claim 3 wherein the support member comprises: a plurality of separated projections defining a plurality of separated slots, the magnetizing conductor is lodged in a slot; and the secondary electrical conductors are lodged in adjacent slots.

7. Apparatus in accordance with claim 3 wherein the support member comprises: a plurality of separated projections, the magnetizing conductor is wrapped around one projection; and the secondary electrical conductors are wrapped around adjacent projections.

8. A method of forming a plurality of adjacent magnetic pole pairs on a magnetizable body comprising the steps of:

forming a magnetic pole pair on the magnetizable body by passing an electric current in a first direction through a primary conductor;

repositioning the primary conductor and the magnetizable body relative to one another whereby the magnetic pole pair previously formed is displaced relative to the primary conductor;

forming an additional magnetic pole pair on the magnetizable body by passing an electric current through the primary conductor in a direction opposite the direction of the electric current used in forming the prior magnetic pole pair, thereby generating primary magnetic field;

dampening the primary magnetic field in the vicinity of an adjacent magnetic pole pair whereby the strength of the adjacent magnetic pole pair is not reduced by the primary magnetic field generated by the electric current in the primary conductor; and repeating the steps of repositioning forming an additional magnetic pole pair and dampening until the desired number of magnetic pole pairs is formed.

9. A method of forming a plurality of adjacent magnetic pole pairs on a magnetizable body in accordance with claim 8 wherein the step of dampening the primary magnetic field includes positioning a changing magnetic field insulator.

10. A method of forming a plurality of adjacent magnetic pole pairs on a magnetizable body in accordance with claim 8 wherein the step of dampening the primary magnetic field includes passing an electric current through secondary conductors in a direction opposite the direction of the current passing through the primary conductor.

* * * * *